US005312543A

United States Patent [19]

Taylor et al.

[11] Patent Number: 5,312,543

[45] Date of Patent: * May 17, 1994

[54] RESID HYDROTREATING USING SOLVENT EXTRACTION AND DEEP VACUUM REDUCTION

[75] Inventors: James L. Taylor, Naperville; William I. Beaton; Bernard Y. C. So, both of Wheaton, all of Ill.; Jeffrey J. Kolstad, Wayzata, Minn.

[73] Assignee: Amoco Corporation, Chicago, Ill.

[ * ] Notice: The portion of the term of this patent subsequent to May 7, 2008 has been disclaimed.

[21] Appl. No.: 902,585

[22] Filed: Jun. 22, 1992

Related U.S. Application Data

[63] Continuation-in-part of Ser. No. 610,936, Nov. 9, 1990, Pat. No. 5,124,024, and a continuation-in-part of Ser. No. 616,219, Nov. 20, 1990, Pat. No. 5,124,025, and a continuation-in-part of Ser. No. 616,208, Nov. 20, 1990, Pat. No. 5,124,026, and a continuation-in-part of Ser. No. 381,372, Jul. 18, 1989, Pat. No. 5,013,427, and a continuation-in-part of Ser. No. 824,289, Jan. 23, 1992, Pat. No. 5,242,578, and a continuation-in-part of Ser. No. 824,508, Jan. 23, 1992, Pat. No. 5,228,978, and a continuation-in-part of Ser. No. 824,509, Jan. 23, 1992, Pat. No. 5,258,117, and a continuation-in-part of Ser. No. 618,218, Nov. 20, 1990, Pat. No. 5,124,027.

[51] Int. Cl.[5] ..... C10G 45/00

[52] U.S. Cl. ..... 208/211; 208/87; 208/89; 208/92; 208/264; 208/309

[58] Field of Search ..... 208/364, 365, 264, 309, 208/251 H, 211, 251

[56] References Cited

U.S. PATENT DOCUMENTS

| | | | |
|---|---|---|---|
| 3,767,564 | 10/1973 | Youngblood et al. | 208/364 |
| 3,886,062 | 5/1975 | Peiser et al. | 208/365 |
| 3,948,756 | 4/1976 | Wolk et al. | 208/264 |
| 5,013,427 | 5/1991 | Mosby et al. | 208/309 |
| 5,124,024 | 6/1992 | Krzywicki et al. | 208/251 H |
| 5,124,025 | 6/1992 | Kolslad et al. | 208/309 |
| 5,124,026 | 6/1992 | Taylor et al. | 208/309 |
| 5,124,027 | 6/1992 | Beaton | 208/309 |

*Primary Examiner*—Helane Myers

*Attorney, Agent, or Firm*—Scott P. McDonald; Richard A. Kretchmer

[57] ABSTRACT

A resid hydrotreating process hydrotreats a resid bottoms fraction from the reduction of crude oil. The hydrotreated bottoms fraction is then subjected to deep vacuum reduction and in some cases deasphalted by solvent extraction to produce an oil suitable for use as a catalytic cracking feedstock and a resins fraction suitable for solvating resid in a hydrotreating process.

18 Claims, 4 Drawing Sheets

RESID HYDROTREATING USING SOLVENT EXTRACTION AND DEEP VACUUM REDUCTION

This application is a continuation-in-part of U.S. application Ser. No. 07/610,936 filed Nov. 9, 1990 now U.S. Pat. No. 5,124,024, and a continuation-in-part of U.S. application Ser. No. 07/616,219 filed Nov. 20, 1990 now U.S. Pat. No. 5,124,025, and a continuation-in-part of U.S. application Ser. No. 07/616,208 filed Nov. 20, 1990, now U.S. Pat. No. 5,124,026, and a continuation-in-part of U.S. application Ser. No. 07/318,372 filed Jul. 18, 1989 now U.S. Pat. No. 5,013,427 and a continuation-in-part of U.S. application Ser. No. 07/824,289 filed Jan. 23, 1992, now U.S. Pat. No. 5,242,578 and a continuation-in-part of U.S. application Ser. No. 07/824,508 filed Jan. 23, 1992, now U.S. Pat. No. 5,228,978 and a continuation-in-part of U.S. application Ser. No. 07/824,509 filed Jan. 23, 1992 now U.S. Pat. No. 5,258,117, and a continuation-in-part of U.S. application Ser. No. 07/618,218 filed Nov. 20, 1990 now U.S. Pat. No. 5,124,027.

FIELD OF THE INVENTION

This invention relates to resid hydroprocessing. The invention more particularly relates to resid hydroprocessing using deep vacuum reduction to fractionate a hydrotreated resid bottoms fraction.

BACKGROUND OF THE INVENTION

Maximizing the yield of highly-valued petroleum products from crude oil requires that refiners convert relatively high-boiling materials such as petroleum residue, better known as resid, to more valuable, lower boiling products. One method for converting resid to more valuable products involves hydrotreating the resid and fractionating the products using a resid hydrotreating unit, or RHU.

Refiners often fractionate hydrotreated resid by atmospheric and/or vacuum distillation. The distillation tower bottoms produced in these units are known as RHU bottoms, hydrotreated resid bottoms fractions or RHU resid. Unlike most lower-boiling hydrotreated materials removed by distillation, RHU bottoms require additional processing to remove materials that foul or poison downstream processing units.

Non-reactive carbonaceous solids are one particularly undesirable component of RHU bottoms. These generally non-reactive solids are known to foul process piping, vessels and valves as they precipitate from RHU bottoms.

RHU bottoms also contain relatively high concentrations of RAMS and of metals such as vanadium and nickel. These metals are particularly undesirable RHU bottom components because they are known to poison various catalysts used in downstream processing equipment such as fluidized catalytic cracking units.

Efficient processing of RHU bottoms preferably requires fractionating the bottoms and reducing the concentration of RAMS carbon, metals and heteroatoms such as nitrogen and sulfur in the lighter bottoms fractions. This permits the lighter, higher quality fractions to be recycled for reprocessing, used as process solvents or diluents or catalytically upgraded to more valuable products. Our U.S. Pat. Nos. 4,940,529; 5,013,427; 5,124,025; 5,124,026 and 5,124,027 disclose several processes for using and upgrading RHU bottoms. Each of these patents is hereby incorporated by reference.

In our processes, two or more solvent extraction steps typically separate the RHU bottoms into two or more fractions generally characterized as asphaltenes, resins and oils. These processes typically fractionate hydrotreated RHU bottoms using a solvent extraction process which processes the bottoms through a series of near-supercritical and supercritical separators operating at a generally constant pressure and successively higher temperatures. In a typical three-stage unit, an asphaltene phase is separated from resins, oils and solvents in a first separator. A second separator separates resins from the deasphalted phase removed from the first separator, and a third separator removes solvent from an oil/solvent phase removed from the second separator.

The relatively heavy asphaltene fraction typically contains high levels of metals and RAMS carbon and can be coked or used as solid fuel. The resin fraction can be recycled to the RHU hydrotreating reactor for mixing with virgin resid feedstock, and the relatively light oil fraction can be catalytically cracked in a fluidized catalytic cracking unit (FCCU) or treated in a catalytic feed hydrotreating unit (CFHU).

While our processes provide a variety of improved methods for separating and using fractions from heavy feedstocks such as RHU bottoms, refiners desire additional processes which simultaneously can maximize the yield of the relatively light oil fraction and minimize the metal, heteroatom and RAMS carbon concentrations in the oil fraction.

It is known that solvent selection can alter the quality and yield of deasphalted oil (DAO) produced in a solvent extraction unit (SEU). Generally, when an SEU employs a relatively high molecular weight solvent, asphaltene yields are reduced and DAO yields maximized. Unfortunately, DAO produced in this manner contains relatively higher levels of RAMS carbon and metals. Conversely, lower molecular weight solvents often yield more asphaltenes and less of a higher quality DAO.

Examples 1 and 2 summarized in Tables 1 and 2 below illustrate SEU solvent selection effects. In Example 1, a three-stage solvent extraction unit employing n-butane solvent separated a hydrotreated resid into asphaltene, resin and oil fractions. The solvent to feed ratio was approximately 8:1 by volume, with the deasphalting, resin/oil and solvent recovery separators operating at about 660 psi and 291, 310 and 350 degrees Fahrenheit, respectively. In Example 2, n-pentane solvent extraction was conducted in an identical solvent extraction unit having three separators operating at about 550 psi and 363, 393 and 450 degrees Fahrenheit. Comparing Examples 1 and 2 illustrates that while the higher molecular weight pentane solvent doubled DAO yields, use of this solvent also increased the heteroatom and RAMS carbon concentration of the DAO.

TABLE 1

| | Resid | Oils | Resins | Asphaltenes |
|---|---|---|---|---|
| Wt % | 100 | 17 | 20 | 63 |
| N, wt % | 0.92 | 0.4 | 0.5 | 1.4 |
| S, wt % | 2.78 | 1.42 | 1.88 | 3.24 |
| Ramsbottom Carbon, wt % | 41 | 6 | 11 | 62 |
| Ni, ppm | 70 | 1 | 2 | 131 |
| V, ppm | 140 | <2 | <2 | 284 |

TABLE 2

| | Resid | Oils | Resins | Asphaltenes |
|---|---|---|---|---|
| Wt % | 100 | 34 | 23 | 43 |
| N, wt % | 0.92 | 0.53 | 0.98 | — |
| S, wt % | 2.78 | 1.80 | 2.22 | 2.99 |
| Ramsbottom Carbon, wt % | 41 | 11 | 23 | 70 |
| Ni, ppm | 70 | 1 | 4 | 192 |
| V, ppm | 140 | <2 | 2 | 329 |

Other examples of solvent selection effects can be found in the paper entitled "How Solvent Selection Effects Extraction Performance", presented in March, 1986 at the National Petroleum Refiners Association Annual Meeting, Paper No. AM-86-36. The examples presented in that paper as well as Examples 1 and 2 above suggest that an improved deasphalting process requires more than solvent optimization if oil yield and quality are to be simultaneous maximized.

Other workers in the field of solvent extraction have attempted to improve solvent extraction processes generally by increasing the number of solvent extraction steps or by recycling various process streams within the solvent extraction unit. For example, U.S. Pat. No. 4,305,814 discloses the use of up to five individual separation steps to further differentiate the components of a hydrocarbonaceous feedstock, while U.S. Pat. Nos. 4,239,616 and 4,290,880 seek to improve SEU performance by recycling a portion of the asphaltene or resin fraction through the same or subsequent separation zones.

While the SEU modifications discussed above may improve SEU performance in some cases, the modified processes are complex, not easily changed as operational requirements vary, or seem unlikely to produce significant improvements in DAO quality without decreasing DAO yields and/or increasing asphaltene yields. Therefore, refiners continue to desire a resid hydrotreating process which includes a deasphalting process capable of minimizing RHU bottoms asphaltene production while at the same time providing an oil fraction having relatively low concentrations of RAMS carbon, metals and/or heteroatoms.

SUMMARY OF THE INVENTION

It is an object of the present invention to provide an improved process for hydrotreating resid and recovering more valuable products therefrom.

It is another object of the invention to provide a resid hydrotreating process which can process a hydrotreated resid bottoms fraction to produce relatively high yields of a relatively high-quality deasphalted oil while at the same time minimizing the production of relatively non-reactive, low-valued asphalt streams.

It is still another object of the invention to provide a means for easily varying the resins and oil yields from a RHU deasphalting unit by varying the boiling point cutoff temperature of a deep vacuum distillation unit.

Other objects of the invention will be apparent as discussed herein. The foregoing objects of the invention can be accomplished by a hydrotreating process comprising the steps of hydrotreating a resid feedstock; fractionating the hydrotreated feedstock into a hydrotreated resid bottoms fraction and at least one relatively lower boiling fraction; and deep vacuum reducing the hydrotreated resid to produce an oil fraction. In several embodiments, a solvent extraction deasphalting step deasphalts the bottoms fraction before or after the vacuum reduction.

As the Examples herein demonstrate, processing a hydrotreated resid bottoms fraction using deep vacuum reduction alone or in combination with solvent extraction can provide a relatively higher yield of a deasphalted oil stream having lower metals, heteroatom and/or RAMS carbon concentrations than if an oil fractionation is accomplished by solvent extraction alone. Furthermore, because much of the quality of the deasphalted oil stream stems from the deep vacuum reduction of the hydrotreated resid bottoms fraction, a deasphalting solvent can be chosen to minimize asphaltene yield without concern for degrading deasphalted oil quality.

Using vacuum reduction also permits the relative yields of oil and resin to be easily adjusted by altering the boiling point cut-off of the vacuum reduction as required by changing feedstock compositions or changes in downstream flow or quality requirements.

DETAILED DESCRIPTION OF THE INVENTION

Figure 1:
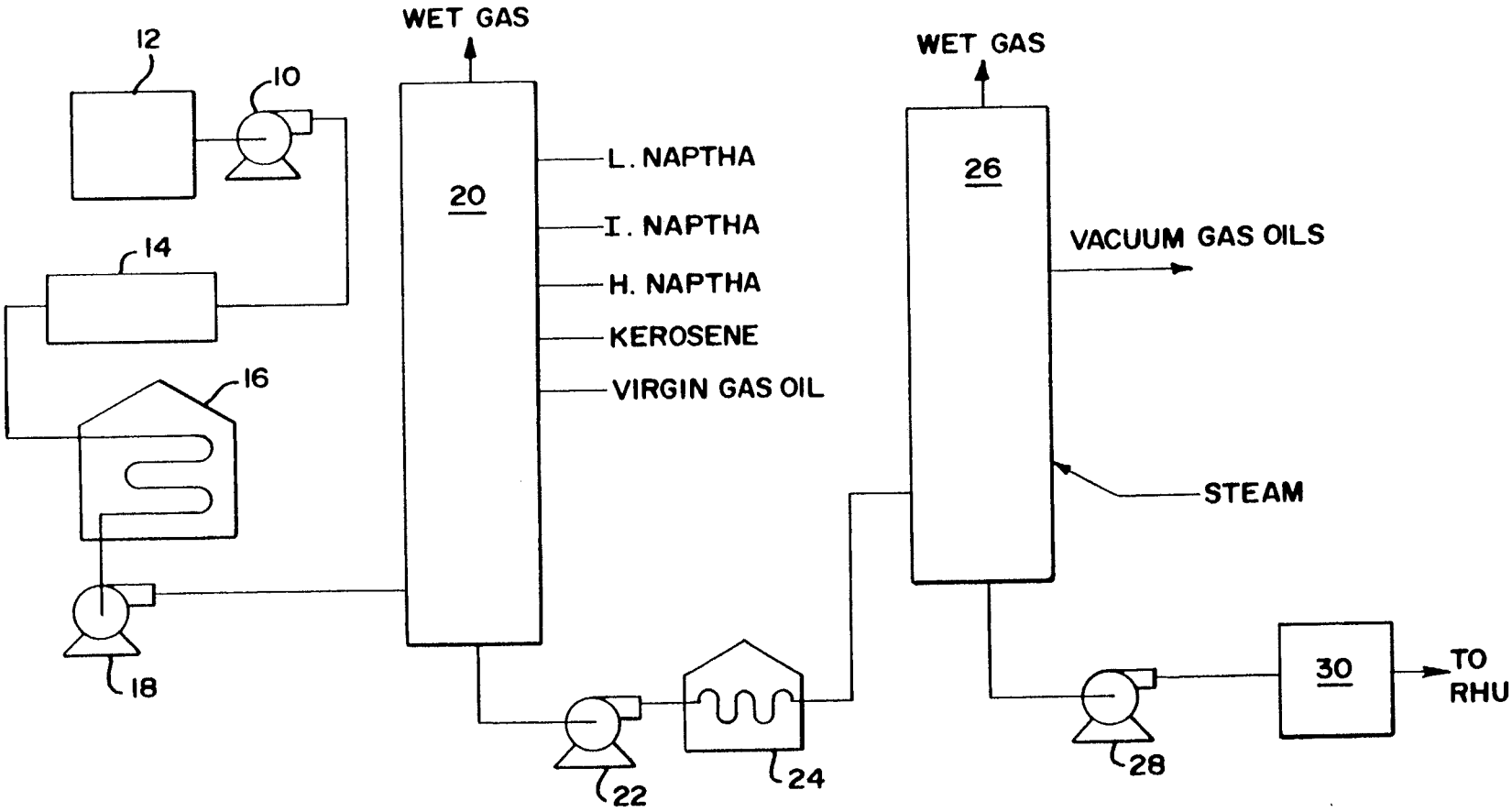
FIG. 1 is a process flow diagram of a crude oil refining unit that produces a resid byproduct.

In the embodiment of the invention discussed below, a virgin resid feedstock produced as a bottoms fraction in the reduction of crude oil is further processed in a resid hydrotreating unit. The hydrotreated effluent from a hydrotreating reactor is fractionated by distillation into one or more lighter products and a hydrotreated resid bottoms fraction. The hydrotreated bottoms fraction is deasphalted by solvent extraction and subjected to deep vacuum reduction to produce a relatively high quality oil feedstream useful as a feedstock for catalytic cracking or catalytic feed hydrogenation. The process also produces an asphaltene fraction useful as solid fuel or coker feedstock, and a reactive resin fraction useful as a process-derived solvent such as for solvating a virgin resid feedstock entering a hydrotreating reactor.

Deep vacuum reduction of the hydrotreated bottoms fraction may be performed either before or after the solvent extraction deasphalting step. It is preferred that the hydrotreated resid bottom fraction be deasphalted by solvent extraction prior to deep vacuum reduction as this minimizes furnace fouling and the heat duty needed to obtain a given overhead fraction, although reversing the order of these steps permits a preexisting RHU vacuum tower to be used to deep vacuum reduce the bottoms fraction. The oil fractions from deep vacuum reduction can be commingled with other vacuum gas oils as it is often desireable to process both streams in a CFHU or FCCU.

"Virgin resid" or "non-hydrotreated resid" useful as resid hydrotreating feedstock is a bottoms fraction produced during the atmospheric or vacuum reduction of crude oil.

"RHU resid", "hydrotreated resid" and "hydrotreated resid bottoms fractions" are the bottoms fraction obtained from the atmospheric or vacuum distillation of hydrotreater effluent.

"Deep vacuum reduction" is a vacuum reduction of a hydrotreated resid bottoms fraction from which most material boiling below 1000 degrees Fahrenheit has already been removed and which employs an upper boiling point cut-off above about 1050 degrees Fahrenheit when converted to atmospheric pressure in accordance with standard tables such as those found in the API Data Book Section 5 published by the American Petroleum Institute (1956).

Solvents useful for deasphalting hydrotreated resid bottoms fractions include non-aromatic hydrocarbons having three to seven carbon atoms and isomers thereof, with alkanes being preferred. The use of a four or five carbon atom solvent is preferred, while the use of n-pentane is most preferred. Preferred solvent extraction processes operate near or above the critical temperature of the solvent, with solvent recovery occuring above the critical temperature of the solvent as described herein.

"Asphaltenes" are heavy, generally polar fractions separated from a RHU bottoms fraction by a solvent extraction unit. Asphaltenes separated from a RHU vacuum bottoms fraction typically contain between 30 and 60 weight percent of Ramsbottom carbon residue and have a hydrogen to carbon atomic ratio of between about 0.5 and 1.2. These asphaltenes generally will contain between about 50 and 5000 ppm of vanadium and between about 20 to 2000 ppm of nickel. Sulfur concentrations in these asphaltenes will be from between about 110 to 250 percent of deasphalting unit feedstream concentration while nitrogen concentrations will range from about 110 to 350 percent of the deasphalting unit feedstream concentration.

"Resins" are an intermediate boiling-range fraction separated from a deasphalted hydrotreated resid bottoms fraction by solvent extraction or as the bottoms fraction of a resin/oil distillation. Resins separated from a RHU vacuum bottoms feed material typically contain between 10 and 30 weight percent of Ramsbottom carbon residue and have a hydrogen to carbon atomic ratio of between about 1.2 and 1.5. These resins can contain less than 300 ppm of vanadium and less than about 100 ppm of nickel. Sulfur concentrations in these resins will be from between about 50 to 200 percent of deasphalting unit feedstream concentration while nitrogen concentrations will range from about 30 to 250 percent of the deasphalting unit feedstream concentration.

The term "oil" means an oil fraction separated from an RHU bottoms fraction by solvent extraction or distillation. Where the oil has been separated from a previously deasphalted feedstock, it is called "deasphalted oil" or "DAO." Oils separated from a RHU vacuum bottoms fraction by deep vacuum reduction can contain less than 10 weight percent of Ramsbottom carbon residue and have a hydrogen to carbon atomic ratio of greater than about 1.45. These oils generally can contain less than about 30 ppm of vanadium and less than about 10 ppm of nickel. Sulfur concentrations in these oils will be less than about 75 percent of deasphalting unit feedstream concentration while nitrogen concentrations will be less than about 70 percent of the deasphalting unit feedstream concentration.

Figure 2:
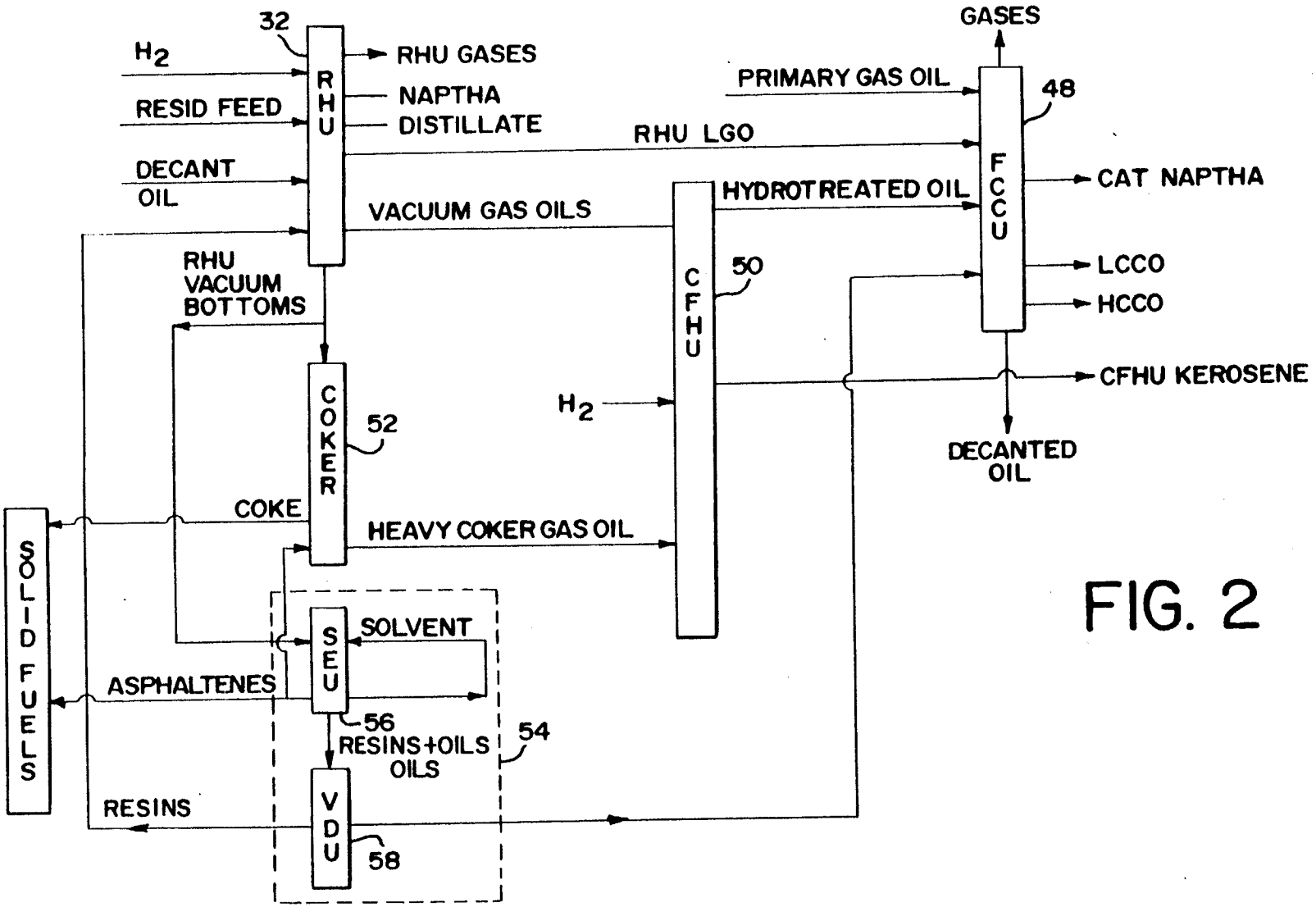
FIG. 2 is a process flow diagram of a refinery including a resid hydroprocessing unit and related processes in accordance with the present invention.

Resid of the type typically treated by a resid hydrotreating unit (RHU) is produced as a by-product of the atmospheric and vacuum distillation of unrefined crude oil (petroleum). FIGS. 1 and 2 illustrate this process as well as the integration into the refining process of a representative resid hydrotreating and deasphalting unit in accordance with the present invention.

Turning first to FIG. 1, a pump 10 pumps crude oil from a storage tank 12 to a desalter 14. Desalter 14 remove particulates such as sand, soft, and metals from the oil. Desalted oil is then fed into a pipestill furnace 16 which heats the oil to a temperature of about 750 degrees Fahrenheit at a pressure ranging from 125 to 200 psi. Pump 18 pumps heated oil from furnace .16 into a primary distillation tower 20.

The heated oil enters a flash zone of tower 20 at a pressure less than about 60 psi. Tower 20 typically separates the heated oil into fractions of wet gas, light naphtha, intermediate naphtha, heavy naphtha, kerosene, virgin gas oil, and primary reduced crude. A portion of the wet gas, naphtha, and kerosene preferably is recycled back to tower 20 to enhance fractionation efficiency. The lighter products such as the naphthas and kerosene typically do not undergo further fractionation, while the gas oil typically flows to a fluidized catalytic cracking unit for cracking and further fractionation.

A pump 22 pumps primary reduced crude from the bottom of primary tower 20 through a furnace 24 which heats the primary reduced crude to a temperature between about 520 and 750 degrees Fahrenheit. The heated crude then passes into the flash zone of a pipestill vacuum tower 26.

Tower 26 preferably is operated at a pressure ranging from 35 to 50 mm of mercury in the presence of steam. Tower 26 typically fractionates the primary reduced crude into wet gas and one or more vacuum gas oils, with vacuum-reduced crude having an initial boiling point of about 1000 degrees Fahrenheit at atmospheric pressure being removed from the bottom of tower 26.

A pump 28 pumps the vacuum-reduced crude bottoms fraction, typically referred to as "resid", into a feed surge drum 30. Virgin resid from drum 30 comprises the feedstock for a resid hydrotreating unit 32 (see FIG. 2) having one or more trains of resid hydrotreating equipment and associated fractionating equipment.

RHU 32 preferably includes multiple trains of series-connected ebullated bed reactors. Unit 32 hydroprocesses a heavy feedstock such as resid in the presence of fresh and/or equilibrium hydrotreating catalyst and hydrogen to produce an upgraded product stream. Hydroprocessing in this manner removes metals, nitrogen, oxygen, sulfur and RAMS carbon from feed material as well as hydrocracking and saturating the feed material. Detailed information concerning the construction and operation of a similar RHU is contained in our U.S. Pat. Nos. 4,940,529 and 5,013,427, the disclosures of which have already been incorporated by reference.

Figure 3:
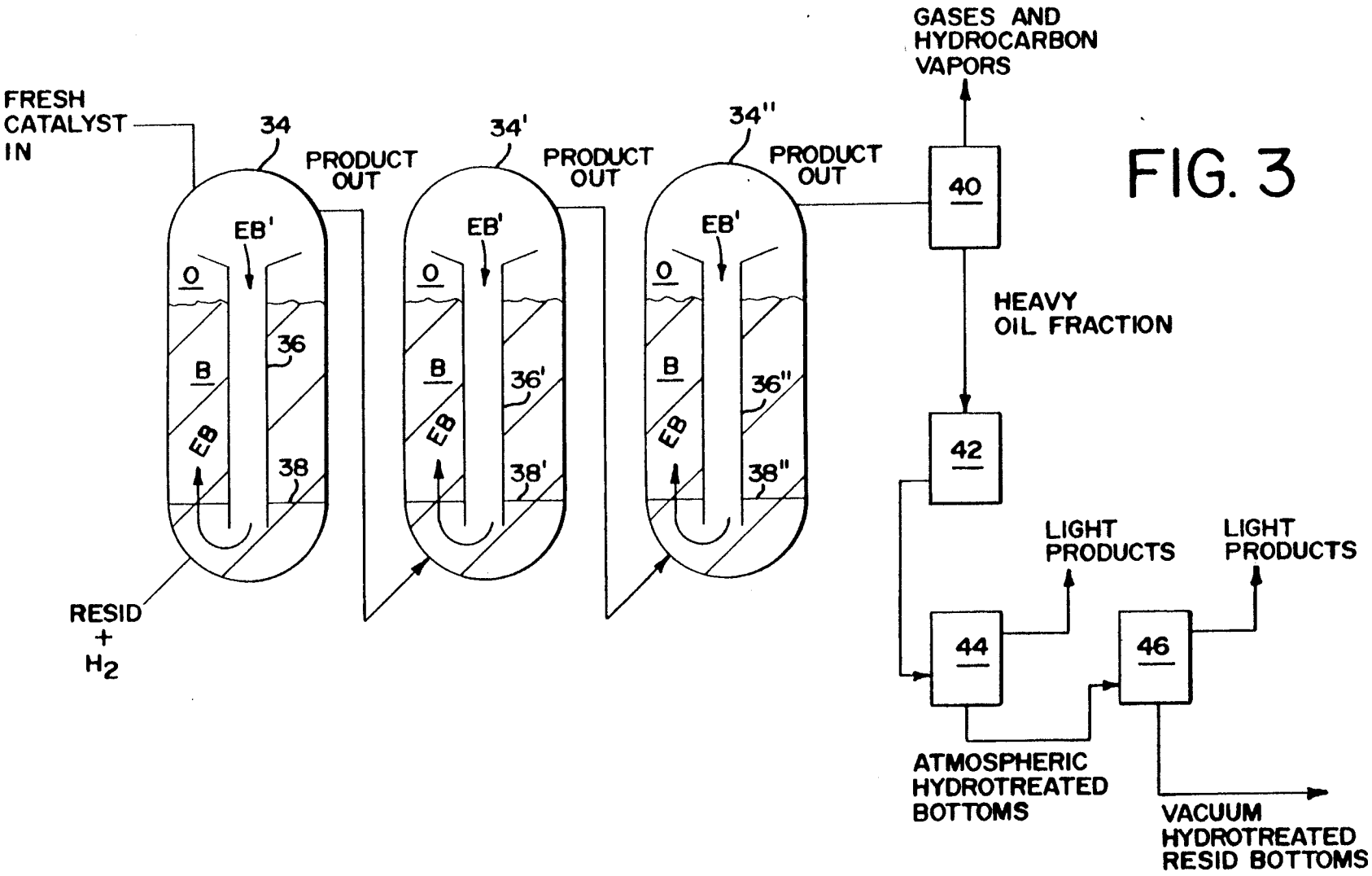
FIG. 3 is a simplified process flow diagram of a resid hydrotreating unit useful in the present invention.

FIG. 3 illustrates a representative single train of three series-connected ebullated bed hydrotreating reactors and associated fractionating equipment. In this embodiment, a hydrogen-rich feed gas preferably containing at least 96 percent hydrogen by volume is heated to between about 650 and 900 degrees Fahrenheit and introduced into the lower portion of a first ebullated bed hydrotreating reactor 34 along with a relatively heavy hydrocarbonaceous feedstream such as resid. The feedstream typically contains about 4 parts resid and 1 part of a solvent such as decanted oil (DCO) from a fluidized catalytic cracking unit or a resin fraction from a solvent extraction unit as discussed below. The feedstream first is heated to between about 650 and 750 degrees Fahrenheit before it is introduced near the bottom of reactor 34. Inside reactor 34 fresh or preferably equilibrium hydrocracking catalyst is ebullated through the heated solvent/resid mixture at a temperature between about 700 and 850 degrees Fahrenheit at a total vessel pressure between about 2650 and 3050 psia and a hydrogen partial pressure between about 1800 and 2300 psia. Hydrotreating catalysts useful in reactor 34 typically comprise a metal hydrogenation component dispersed on a porous, refractory, inorganic oxide support. Residence times within the first and subsequent hydrotreating reactors typically range from 0.5 to 1.0 LHSV each.

Catalyst, hydrogen-rich gas and the heated feedstream circulate upwardly through an expanded catalyst bed B in the direction of arrow EB, with hydrotreated product and hydrogen-rich gas being withdrawn from near the top of vessel 34. A portion of the oil product 0 is drawn downwardly in the direction of arrow EB' through a downcomer 36 by an ebullated pump (not illustrated) and used to ebullate bed B by forcing the recycle stream upwardly across a distributor plate 38. Plate 38 preferably includes a plurality of bubble caps and risers (not illustrated) for distributing circulating oil and gas more uniformly across reactor 34.

An upgraded process stream from first reactor 34 is transferred to a second ebullated bed reactor 34'. If desired, a quench liquid such as sponge oil or a quench gas such as a mixture of upgraded methane-lean gases and/or fresh makeup gases may be added to the process stream prior to the process stream entering second reactor 34'. This mixture is ebullated in the presence of spent hydrocracking catalyst removed from a third downstream reactor 34''. Hydrotreating conditions within reactor 34' include at a temperature between about 700 and 850 degrees Fahrenheit at total vessel pressure between about 2600 and 3000 psia, and a hydrogen partial pressure between about 1700 and 2100 psia.

An upgraded process stream from second reactor 34' is transferred to third reactor 34'' with or without liquid or gas quench as already discussed. The process stream again is ebullated in the presence of hydrocracking catalyst at a temperature between about 700 and 850 degrees Fahrenheit, at a total vessel pressure between about 2250 and 2950 psia, and a hydrogen partial pressure between about 1600 and 2000 psia to produce a furtherupgraded process stream.

The process stream from third reactor 34'' is transferred with or without liquid or gas quench to a high temperature separator 40 operating between about 700 and 850 degrees Fahrenheit at a pressure between about 2500 and 2900 psia. Separator 40 yields an overhead stream of gases and oil system vapors and a high temperature heavy oil fraction which passes to a flash drum system 42 and is distilled in an atmospheric tower 44. The bottoms fraction from atmospheric tower 44 is heated and further fractionated in a vacuum tower 46 which yields as its bottoms fraction hydrotreated resid. This resid routinely contains predominently material boiling above about 850 degrees Fahrenheit and preferably above about 1000 degrees Fahrenheit at atmospheric pressure. RHU conversion to 1000 degree Fahrenheit minus products should be at least 30 percent of feed by volume, preferably 50 percent by volume, and most preferably 65 percent by volume.

While the use of a series of ebullated bed hydrotreating reactors such as those just discussed is preferred, other hydrotreating processes may be used as well. If another hydrotreating process is used, it is preferred that conversion of resid to 1000 degree Fahrenheit minus material be at least 50 percent by volume.

Hydrotreated products produced in RHU 32 include light hydrocarbon gases, light, intermediate and heavy naphthas, light and mid-range distillates, light gas oils, light and heavy vacuum gas oil, and vacuum tower bottoms hereafter referred to as vacuum RHU resid. Light and intermediate naphthas are useful as gasoline blending stocks and reformer feed. Heavy naphtha can be sent to a reformer (not illustrated) to produce gasoline. The distillates are useful for producing diesel fuel and furnace oil, as well as for conveying and/or cooling spent RHU catalyst. Light gas oil is useful as feedstock for a fluidized catalytic cracking unit (FCCU) 48, while vacuum gas oils can be upgraded in a catalytic feed hydrotreating unit 50 (CFHU) and subsequently cracked in FCCU 48.

While some of the RHU resid can be sent to a coking unit 52 to produce coke, a substantial portion is fed to a deasphalting unit 54 for further fractionation.

As will be discussed in detail in conjunction with FIG. 4, deasphalting unit 54 principally comprises a solvent extraction unit (SEU) 56 and a vacuum distillation unit 58. SEU 56 is a two-stage unit operating with supercritical solvent extraction. SEU 56 produces a deasphalted, solvent-free oil/resin fraction and an asphaltene fraction. Vacuum distillation unit (VDU) 58 separates the resin/oil fraction into a resin fraction and an oil fraction. The resin fraction can be recycled to RHU 32 for coprocessing with nonhydrotreated resid, as recycling tie resin fraction is believed to increase the yield of more valuable lower-boiling liquid hydrocarbons, control the carbonaceous solids and reduce cracking catalyst fines in the RHU. The oil fraction preferably is fed to FCCU 48 for catalytic cracking. Asphaltenes separated from the hydrotreated vacuum resid by SEU 56 typically are sent to a solids fuel mixing or storage unit 60 or returned to coker 52.

Figure 4:
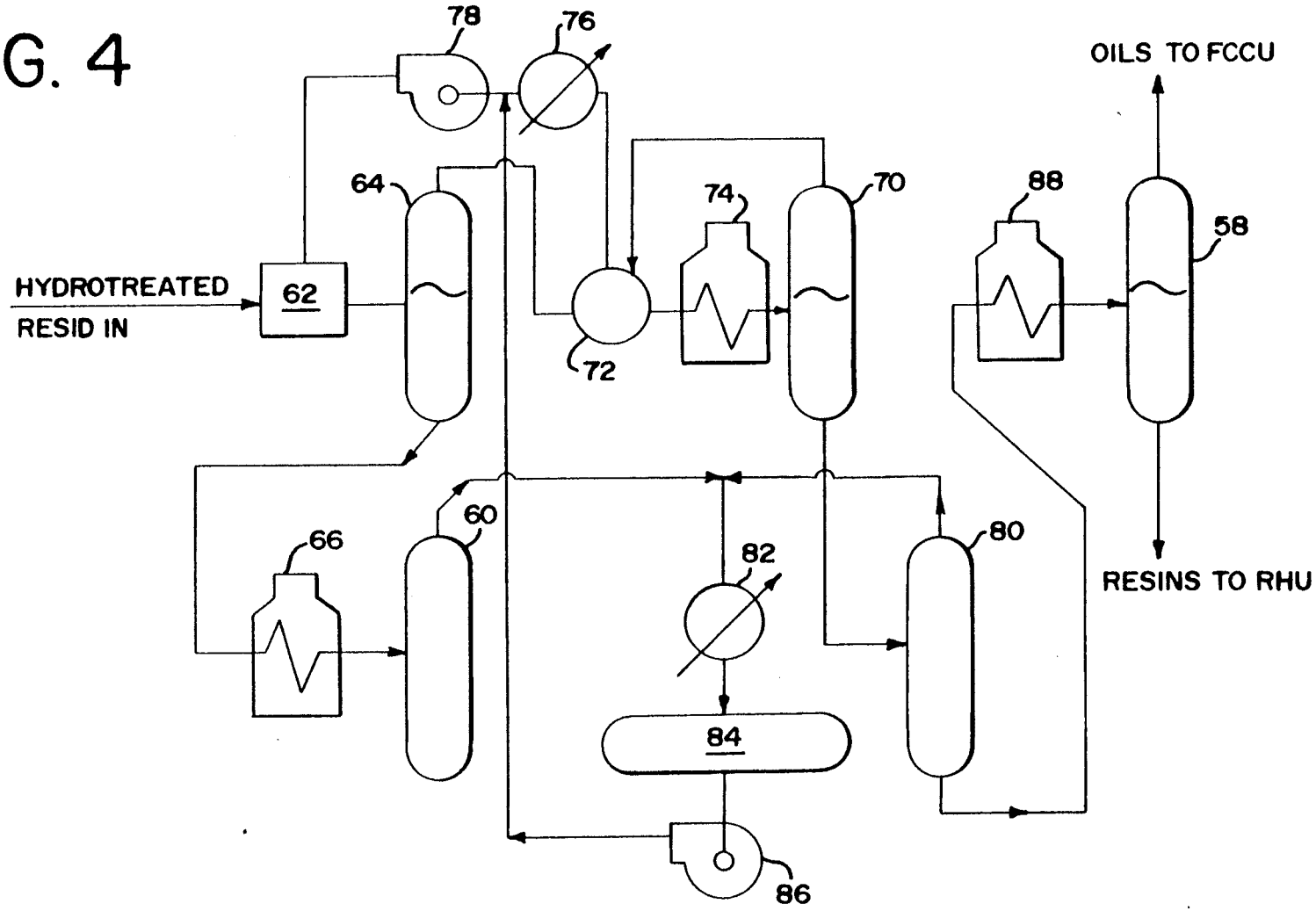
FIG. 4 is a detailed process flow diagram of a deasphalting unit in accordance with the present invention.

FIG. 4 is a detailed process flow diagram of an improved deasphalting unit 54 in accordance with the present invention. Because deasphalting unit 54 uses a vacuum distillation unit 58 to separate the resin and oil fractions produced by solvent extraction unit 56, unit 54 provides a higher quality oil fraction for cracking in FCCU 48 than if the oil were separated from the resins by an additional solvent extraction stage.

SEU 56 employs a liquid organic solvent to separate asphaltenes from a hydrotreated resid vacuum distillation bottoms feedstock. Preferred SEU solvents include non-aromatic $C_3$–$C_7$ hydrocarbons and combinations thereof, with pentane and butane and isomers thereof being more preferred, and n-pentane being most preferred. The critical temperatures and pressures for the solvents generally used in SEU 56 are as follows:

| | T (°F.) | P (PSIG) |
|---|---|---|
| n-propane | 206 | 601 |
| n-butane | 307 | 530 |
| isobutane | 275 | 514 |
| n-pentane | 387 | 484 |
| n-hexane | 455 | 435 |
| n-heptane | 512 | 395 |

Referring now to FIG. 4, n-pentane solvent and a hydrocarbon feedstream comprising RHU vacuum resid are mixed together in a mixer 62 and introduced into a first separation vessel or separator 64. The solvent to hydrocarbon feed ratio typically is from about 3:1 to about 20:1 and preferably from about 8:1 to about 12:1. In some embodiments, a substantial fraction of the solvent may be added directly to first separator 64 to effect countercurrent extraction of the asphaltenes in vessel 64. Alternatively, RHU resid and solvent can be fed directly into and initially mixed within vessel 64.

First separator 64 can be operated at a temperature from about 150 degrees Fahrenheit to above the critical temperature of the solvent. Operating pressure should be at least equal to the vapor pressure of the solvent when operating below the critical temperature of the solvent and at least equal to the critical pressure of the solvent when operating at a temperature equal to or above the critical temperature of the solvent. Preferably, the operating temperature of separator 64 is between 50 degrees Fahrenheit below the critical temperature and the critical temperature. Most preferably, the operating temperature of separator 64 ranges from about 20 degrees Fahrenheit below the critical temperature of the solvent to about the critical temperature of the solvent. Operating pressure preferably is just above the critical pressure to 250 psi above the critical pressure.

The lower asphaltene phase from separator 64 is withdrawn, heated in a heater 66 and stripped of entrained solvent in a stripper 68. The resin/oil/pentane upper phase mixture overheads from first separator 64 pass through a heat exchanger 72 and a heater 74 prior to entering second separation vessel 70. The operating temperature of separator 70 preferably is higher than the temperature in the second separator 54 and above the critical temperature of the solvent. Most preferably, the temperature in second separator 70 is maintained at least about 50 degrees Fahrenheit above the critical temperature of the solvent. The operating pressure of separator 70 should be about the same as separator 64. Because separator 70 operates at supercritical solvent conditions, no heat of vaporization is required to separate the solvent from the oil/resin mixture, thereby enhancing the energy efficacy of SEU 56. Solvent removed from separator 70 passes through heat exchanger 72 to heat the resin/oil/solvent mixture entering separator 70, is cooled by a cooler 76, and is pumped by a pump 78 back to mixer 62 where it is mixed with fresh RHU resid.

The solvent-lean resin/oil phase from separator 70 passes through a stripper 80 which removes entrained solvent from the resin/oil fraction before that fraction passes on to vacuum distillation unit 58. Solvent stripped from the resin/oil fraction passes from strippers 68 and 80 through a cooler 82 and into a solvent surge tank 84. A solvent make-up pump 86 can be used to transfer make-up solvent toward pump 78 for make-up to mixer 62.

The stripped resin/oil fraction from stripper 80 next passes through a heater 88 where it is heated to a temperature of between 600 and 880 degrees Fahrenheit, and preferably between about 700 and 800 degrees Fahrenheit. The heated resin/oil fraction then undergoes a deep vacuum reduction in vacuum distillation unit 58 to produce an oil overhead fraction and a resin bottoms fraction. The boiling point cut for the deep vacuum reduction can be 1250 degrees Fahrenheit or higher but preferably is 1150 and most preferably 1100 is degrees Fahrenheit when converted to atmospheric pressure. As used herein, boiling point cuts are meant to refer to a cut in which a substantial amount of the fraction achieves a desired specification. Use of this term does not preclude the presence of relatively small amounts of out-of-specification "tails" material which typically contaminate petroleum fractions obtained by distillation.

The resin bottoms fraction from vacuum distillation unit 58 can be returned to RHU 32 as previously discussed. The oil overhead fraction from unit 58 can be processed without further treatment in FCCU 48. Alternatively, the oil fraction can pass into catalytic feed hydrotreating unit 50 for processing prior to cracking in FCCU 48.

The surprising superiority of RHU resid processing using solvent extraction deasphalting and deep vacuum reduction is illustrated by the following examples.

Examples 3, 4, 5 and 6 demonstrate that three stage solvent extraction fractionation of virgin resid generally is preferred to deep vacuum reduction of virgin resid. Examples 7, 8 and 9 illustrate that deep vacuum reduction of hydrotreated resid unexpectedly provides a relatively high yield of a relatively high quality oil fraction either alone or preferably in combination with solvent extraction deasphalting.

EXAMPLE 3

In this example, a low-sulfur virgin resid was processed in a three-stage solvent extraction unit. The solvent extraction unit was similar in concept to that described in connection with the preferred embodiment above but was a three stage unit having an additional separator stage for separating oils and resins by solvent extraction prior to solvent recovery. Butane was used as a solvent. The analyses of the non-hydrotreated resid and fractions obtained by solvent extraction are summarized below. These results were originally published by the Kerr-McGee Corporation at the Spring 1985 AICHE Meeting in Houston, Texas held from Mar. 24–28, 1985.

| | Resid | Oils | Resins | Asphaltenes |
|---|---|---|---|---|
| Wt % | 100 | 75 | 9 | 16.5 |
| N, wt % | 0.36 | 0.3 | 0.34 | 0.62 |
| S, wt % | 1.4 | 1.25 | 1.5 | 2.1 |
| Ramsbottom Carbon, wt % | 14 | 7 | 12 | 42 |
| Ni, ppm | 10 | 4 | 6 | 42 |
| V, ppm | 20 | 4 | 9 | 96 |

EXAMPLE 4

In this Example, a high-sulfur virgin resid was fractionated using a three-stage solvent extraction unit as in Example 3. Operating conditions for the first separator were about 660 psi and 307 degrees Fahrenheit, with a butane solvent to feed ratio of about 12:1 by volume. The analyses of the non-hydrotreated resid and fractions obtained by solvent extraction are summarized below.

| | Resid | Oils | Resins | Asphaltenes |
|---|---|---|---|---|
| Wt % | 100 | 40 | 15 | 46 |
| N, wt % | 0.54 | 0.27 | 0.45 | 0.94 |
| S, wt % | 4.1 | 3.1 | 4.1 | 4.9 |
| Ramsbottom Carbon, wt % | 22 | 4 | 14 | 40 |
| Ni, ppm | 55 | 10 | 24 | 107 |

-continued

| | Resid | Oils | Resins | Asphaltenes |
|---|---|---|---|---|
| V, ppm | 187 | 8 | 59 | 393 |

EXAMPLE 5

In this example, a low-sulfur virgin resid like the one in Example 3 was subjected to a deep vacuum reduction. The characteristics of the whole resid and the respective fractions obtained through the deep vacuum reduction are summarized below. As in each of the following examples, temperatures have been corrected to atmospheric pressure.

| | Resid | 1050° F. | 1050–1100° F. | 1100–1150° F. | 1150–1200° F. | 1200–1250° F. | 1250+° F. |
|---|---|---|---|---|---|---|---|
| Wt % | 100 | 20 | 9 | 11 | 10 | 10 | 40 |
| H/C Atomic Ratio | 1.58 | 1.68 | 1.65 | 1.67 | 1.66 | 1.64 | 1.46 |
| N, wt % | 0.36 | 0.18 | 0.26 | 0.26 | 0.30 | 0.34 | 0.53 |
| S, wt % | 1.00 | 0.77 | 0.62 | 0.99 | 0.82 | 0.95 | 1.25 |
| Rams carbon, wt. % | 12 | 2 | 5 | 5 | 8 | 7 | 24 |
| Ni, ppm | 19 | 6 | 13 | 12 | 14 | 10 | 32 |
| V, ppm | 13 | 3 | 6 | 8 | 5 | 5 | 26 |

EXAMPLE 6

In this example, a high-sulfur resid like the one in Example 4 was subjected to a deep vacuum reduction. The characteristics of the whole resid and the respective fractions obtained through the reduction are summarized below.

| | Whole Resid | 1050° F | 1050–1100° F | 1100–1150° F. | 1150–1200° F. | 1200–1250° F. | 1250+° F. |
|---|---|---|---|---|---|---|---|
| Wt % | 100 | 29 | 9 | 8 | 6 | 4 | 44 |
| H/C Atomic Ratio | 1.47 | 1.58 | 1.60 | — | — | — | 1.35 |
| N, wt % | 0.52 | 0.22 | 0.24 | 0.41 | 0.35 | 0.30 | 0.84 |
| S, wt % | 3.75 | 2.83 | 2.81 | 3.5 | 3.8 | 3.4 | 4.62 |
| Rams carbon, wt. % | 20 | 3 | 8 | 11 | 11 | 14 | 37 |
| Ni, ppm | 56 | 0 | 13 | 20 | 22 | 25 | 115 |
| V, ppm | 222 | 15 | 107 | 146 | 130 | 116 | 416 |

As can be seen be comparing Examples 3 and 4 to Examples 5 and 6, solvent extraction provides oils containing generally lower Ramsbottom carbon and metals compared to a similar yield of oil obtained by deep vacuum reduction. This suggests that a three-stage solvent deasphalting process may be preferable to deep vacuum reduction where a virgin resid is to be fractionated to obtain oils for use as a FCCU feedstock. This is consistent with operating experience that suggests that deep vacuum reduction of non-hydrotreated resid requires a maximum boiling point cutoff no higher than about 1000 degrees Fahrenheit (atmospheric) to limit metal carryover to the FCCU, thereby minimizing the potential for catalyst contamination.

EXAMPLE 7

In this example, a hydrotreated RHU resid was deasphalted and vacuum reduced in a manner similar to that described in conjunction with FIG. 3. Conversion of 1000 degree plus (atmospheric pressure) material to 1000 degree minus material in the hydrotreater was about 75 vol. %, with the 1000 degree minus hydrotreated products being removed by distillation prior to deasphalting and deep vacuum reduction. The hydrotreated resid was deasphalted with a n-hexane solvent at about 150 degrees Fahrenheit and at about atmospheric pressure to produce a yield similar to that obtained using pentane at near critical conditions. The results are summarized in Table 3, below. This Example illustrates that a solvent extraction/vacuum reduction process can provide relatively high yields of a high quality 1000 degree Fahrenheit plus oil suitable for use as a FCCU feedstream.

TABLE 3

| | RHU Resid before Deasphalting | Deasphalted Resid | 1050° F. | 1050–1100° F. | 1100–1150° F. | 1150–1200° F. | 1200–1250° F. | 1250+° F. |
|---|---|---|---|---|---|---|---|---|
| Wt % | — | 100 | 40 | 15 | 13 | 8 | 7 | 17 |
| H/C Atomic Ratio | 1.26 | 1.43 | 1.44 | 1.42 | 1.45 | 1.44 | 1.52 | 1.35 |
| N, wt % | 0.64 | 0.49 | 0.38 | 0.39 | 0.46 | 0.42 | 0.55 | 0.78 |
| S, wt % | 1.38 | 1.14 | 1.0 | 1.1 | 1.1 | 1.1 | 0.2 | 1.8 |
| Rams carbon, wt. % | 28 | 14 | 4 | 12 | 13 | 9 | 21 | 33 |
| Ni, ppm | 46 | 2 | 0 | 0 | 0 | 0 | 0 | 13 |
| V, ppm | 90 | 4 | 0 | 0 | 0 | 0 | 0 | 24 |

EXAMPLE 8

In this example, a hydrotreated resid bottoms fraction similar to that of Example 7 was vacuum reduced without deasphalting. Conversion of 1000 degree plus (atmospheric pressure) material to 1000 degree minus material in the hydrotreater was about 65 percent by volume, with the 1000 degree minus hydrotreated products being removed by distillation prior to deep vacuum reduction. As in Example 7, this Example illustrates that deep vacuum reduction can be used advantageously to produce a high yield of oils useful as a FCCU feedstock. It should be noted, however, that both the Ramsbottom carbon residue and metals concentrations of the lighter oil cuts generally are somewhat higher when a deasphalting step does not precede the deep vacuum reduction. Analyses of the whole resid and the various boiling fractions are summarized below.

| | RHU Resid | 1050° F. | 1050–1100° F. | 1100–1150° F. | 1150–1200° F. | 1200–1250° F. | 1250+° F. |
|---|---|---|---|---|---|---|---|
| Wt % | 100 | 36 | 12 | 10 | 7 | 6 | 29 |
| H/C Atomic Ratio | 1.39 | 1.53 | 1.44 | 1.46 | 1.38 | 1.46 | 1.15 |
| N, wt % | 0.54 | 0.36 | 0.40 | 0.46 | 0.47 | 0.55 | 0.86 |
| S, wt % | 1.93 | 1.45 | 1.53 | 1.91 | 2.14 | 1.94 | 2.65 |
| Rams carbon, wt. % | 22 | 6 | 9 | 20 | 28 | 16 | 48.4 |
| Ni, ppm | 21 | 0 | 0 | 17 | 6 | 14 | 64 |
| V, ppm | 19 | 3 | 3 | 9 | 4 | 16 | 53 |

EXAMPLE 9

Example 9 compares the results of RHU resid fractionation by solvent extraction only and by solvent extraction in combination with deep vacuum reduction. In each case, deasphalting was performed using a n-pentane solvent at about 375 degrees Fahrenheit and 550 psi with a solvent to feed ration of about 8:1 by volume. In the first instance, a second solvent extraction was conducted at about 400–450 degrees Fahrenheit and 550 psi to produce resin and oil fractions, while in the second instance, the oil/resin fractionation was conducted by deep vacuum reduction with a cut point of 780 degrees Fahrenheit at 10 millimeters of mercury (corresponding to 1140 degrees Fahrenheit at atmospheric pressure). As can be seen by comparing the results in Table 4 below, nickel and vanadium concentrations in the oil fractions were less than 4 ppm. Most significantly, the deep vacuum reduction oil/resin separation produced a higher yield of oil having a lower heteroatom and Ramsbottom carbon residue than the oil produced by solvent extraction.

TABLE 4

| | Hydrotreated Resid | Deasphalted Resid | Solvent Extraction | | Deep Vacuum Reduction | |
|---|---|---|---|---|---|---|
| | | | Oils | Resins | Overhead (oils) | Residue (resins) |
| Wt % of deasphalted oil | — | — | 53 | 47 | 56 | 44 |
| H/C Atomic Ratio | 1.30 | 1.45 | 1.48 | 1.42 | 1.46 | 1.43 |
| N, wt % | 0.83 | 0.52 | 0.41 | 0.49 | 0.39 | 0.55 |
| S, wt % | 2.13 | 1.67 | 1.45 | 1.73 | 1.17 | 1.93 |
| Rams carbon, wt. % | 27 | 12 | 8 | 14 | 4 | 21 |
| Ni, ppm | <4 | <4 | <4 | <4 | <4 | <4 |
| V, ppm | <4 | <4 | <4 | <4 | <4 | <4 |

As can be seen by comparing the vacuum reduction results to the solvent extraction results, using deep vacuum reduction to fractionate the deasphalted oil and resin feedstream produced a higher yield of deasphalted oil containing extremely low metals concentrations and less Ramsbottom carbon residue, sulfur and nitrogen than the oil produced by fractionating the oils and resins using solvent extraction.

The foregoing experimental results show that deep vacuum reduction provides an unexpected advantage when used alone or in combination with solvent extraction to obtain from a hydrotreated resid an oil fraction suitable for use as FCCU feedstock While the foregoing discussion identifies several embodiments of this invention, other embodiments not departing from the spirit of the invention will be apparent to those of ordinary skill in the art after reviewing this disclosure. Therefore, the scope of the invention is intended to be limited only by the following claims.

We claim:

1. A hydrotreating process comprising the steps of:

hydrotreating a resid feedstock at a temperature between about 700° and 850° F., at a total pressure of between about 2650 and 3050 psig, and at a hydrogen partial pressure of between 1800 and 2300 psig;

thereafter the hydrotreating step fractionating the hydrotreated feedstock into a hydrotreated resid bottoms fraction and at least one relatively lower boiling fraction;

thereafter the fractionating step deasphalting the bottoms fraction to remove an asphaltene fraction therefrom; and thereafter the deasphalting step deep-vacuum reducing the hydrotreated resid bottoms fraction to produce an oil fraction having an upper boiling point cut-off temperature of at least 1050° F.

2. The process of claim 1 wherein the deasphalting step includes solvent extracting the hydrotreated resid bottoms fraction with one or more non-aromatic deasphalting solvents containing three to seven carbon atoms to produce a resin- and oil-rich solvent fraction and the asphaltene fraction.

3. The process of claim 2 wherein the deasphalting is accomplished at a temperature above about 50° F. below a critical temperature of the solvent.

4. A process for fractionating a bottoms fraction from a resid hydrotreating unit, said bottoms fraction having been hydrotreated in the hydrotreating unit at a temperature between about 700° and 805° F., at a total pressure of between about 2650 and 3050 psig, and at a hydrogen partial pressure of between 1800 and 2300 psig, said process comprising the steps of:

thereafter the hydrotreating step removing a substantial portion of material boiling below 850 degrees Fahrenheit from the hydrotreated resid bottoms fraction;

thereafter deasphalting the bottoms fraction to produce an asphaltene fraction and a resin- and oil-rich fraction; and thereafter the deasphalting step deep-vacuum reducing the resin- and oil-rich fraction to produce an oil overhead fraction having an upper boiling point cut-off temperature of at least 1050° F. and a resin bottoms fraction.

5. The process of claim 4 wherein the deasphalting step includes solvent extracting the bottoms fraction with one or more alkane solvents containing three to seven carbon atoms at a temperature above about 50° F. degrees below the critical temperature of the solvent.

6. The process of claim 5 wherein the solvent contains four or five carbon atoms.

7. The process of claim 4 wherein the hydrotreated resid bottoms fraction is produced by reacting a virgin resid in an ebullated bed reactor in the presence of a hydrocracking catalyst and a hydrogen-rich gas and thereafter removing the substantial portion of material boiling below 850 degree Fahrenheit by distillation.

8. The process of claim 4 wherein the deasphalting step includes the steps of:

solvent extracting the bottoms fraction with an alkane solvent containing three to seven carbon atoms at a temperature above about 50 degrees below the critical temperature of the solvent to produce the asphaltene fraction and the resin- and oil-rich solvent fraction;

separating the asphaltene fraction from the resin- and oil-rich solvent fraction; and increasing the temperature of the resin- and oil-rich solvent fraction to at least 50 degrees above the critical temperature of the solvent to produce a solvent fraction and a resin and oil fraction.

9. The process of claim 8 wherein the solvent is n-pentane.

10. The process of claim 4 wherein the substantial portion of 850 degree Fahrenheit minus products are separated from the hydrotreated resid by atmospheric and vacuum distillation.

11. The process of claim 4 wherein a substantial portion of the oil fraction produced by deep vacuum reduction boils below about 1150 degrees Fahrenheit at atmospheric pressure.

12. A process for hydrotreating a resid and producing an oil feedstock therefrom comprising the steps of:

hydrotreating a virgin resid feedstream by reacting the resid in an ebullated bed reactor in the presence of a hydrocracking catalyst and a hydrogen-rich gas at a temperature between about 700° and 850° F., at a total pressure of between about 2650 and 3050 psig, and at a hydrogen partial pressure of between 1800 and 2300 psig to produce a hydrotreated effluent stream;

thereafter the hydrotreating step removing a substantial portion of material boiling below 1000 degrees Fahrenheit from the hydrotreated effluent stream by distillation, thereby producing a hydrotreated resid bottoms fraction;

thereafter the distilling step solvent extracting the bottoms fraction with an alkane solvent containing three to seven carbon atoms at a temperature above about 20 degrees below the critical temperature of the solvent to produce an asphaltene fraction and a resin- and oil-rich solvent fraction;

thereafter the solvent extracting step separating the asphaltene fraction from the resin- and oil-rich solvent fraction; and increasing the temperature of the resin- and oil-rich solvent fraction to at least 50 degrees above the critical temperature of the solvent to produce a solvent fraction and a resin and oil fraction; and thereafter the separating step deep-vacuum reducing the resin- and oil-rich fraction to produce a resin bottoms fraction and an overhead oil fraction containing a substantial portion of material having an upper boiling point cut-off temperature below about 1200 degrees Fahrenheit at atmospheric pressure.

13. The process of claim 12 wherein the solvent is n-pentane.

14. The process of claim 12 wherein the virgin resid feedstream is a bottoms fraction from the vacuum reduction of crude oil.

15. The process of claim 12 wherein a distillation in the removing step is a vacuum distillation.

16. The process of claim 12 wherein a substantial portion of the oil fraction produced by deep vacuum reduction boils below about 1150 degrees Fahrenheit, at atmospheric pressure.

17. The process of claim 12 wherein at least a portion of the resin fraction is recycled to the ebullated bed reactor to solvate virgin resid fed into the reactor.

18. The process of claim 12 wherein the distilled oil fraction is thereafter processed by catalytically cracking the oil in a fluidized catalytic cracking unit, or first pretreating the oil in a catalytic feed hydrotreating unit and then catalytically cracking effluent from the hydrotreating unit.

* * * * *